United States Patent [19]

May

[11] 4,397,773

[45] Aug. 9, 1983

[54] VARISTOR WITH TETRAGONAL ANTIMONY ZINC OXIDE ADDITIVE

[75] Inventor: John E. May, Skaneateles, N.Y.

[73] Assignee: General Electric Company, Syracuse, N.Y.

[21] Appl. No.: 191,314

[22] Filed: Sep. 26, 1980

[51] Int. Cl.[3] ..... H01B 1/06

[52] U.S. Cl. ..... 252/518; 252/519; 252/520; 29/610 R; 338/20; 264/61; 264/66

[58] Field of Search ..... 252/518, 519, 520, 521; 338/20, 21; 264/60, 61, 66, 104, 232, 235; 75/211, 213, 214, 226, 206; 29/610 R; 423/622, 617, 592, 593

[56] References Cited

U.S. PATENT DOCUMENTS

| | | | |
|---|---|---|---|
| 4,127,511 | 11/1978 | Klein et al. | 252/518 |
| 4,147,670 | 4/1979 | Shohata et al. | 252/519 |
| 4,169,071 | 9/1979 | Eda et al. | 252/518 X |

*Primary Examiner*—Josephine Barr

*Attorney, Agent, or Firm*—Robert J. Mooney

[57] ABSTRACT

A low varistor voltage, low leakage metal oxide varistor and especially a zinc oxide varistor is provided by adding a few percent of tetragonal antimony zinc oxide to the varistor mixture prior to sintering. A method for manufacturing the additive as well as a method for manufacturing a varistor including the additive are described.

5 Claims, 1 Drawing Figure

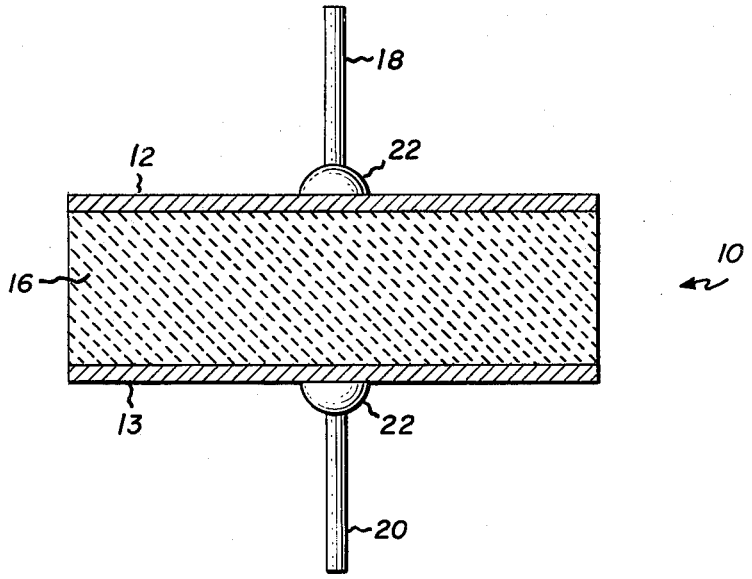
18
22
12
10
16
13
22
20

VARISTOR WITH TETRAGONAL ANTIMONY ZINC OXIDE ADDITIVE

This invention relates in general to metal oxide varistors and more particularly to an additive for metal oxide varistors and a process employing the additive which decreases leakage and greatly increases the size of metal oxide grains in the varistor body so as to decrease the varistor voltage.

Voltage dependent resistors (varistors) have become increasingly widely employed for the suppression of electrical transients and the stabilization of voltages in electrical circuits. The electrical characteristics of such varistors may be expressed by the relation: $I=(V/C)^{\alpha}$; where V is the voltage applied to the terminals of the device, I is the current flowing therethrough and C is a constant, the varistor voltage, corresponding to the voltage at a given current and alpha is a number greater than one. The value of alpha represents the degree of non-linearity of the varistor and is generally accepted to be a significant figure of merit for the device. The value for C determines the magnitude of impressed voltage at which further increases in voltage result in relatively greater increases in current than occur for similar changes in voltage at lower magnitudes. The value for alpha may be calculated according to the following equation: $\alpha=\log_{10}(I_2/I_1)/\log_{10}(V_2/V_1)$ where $V_1$ and $V_2$ are the device voltages at currents $I_1$ and $I_2$ respectively. The values of C and alpha are functions of the varistor formulation and the manufacturing process employed.

In certain varistor applications where relatively low circuit voltages are employed, that is to say on the order of a few tens of volts, such as applications in vehicles, low voltage power supplies and the like, it is desirable to provide a varistor having a low value for C. Heretofore the fabrication of such varistors has been complicated by the apparent interdependence between the value of C and the alpha of the varistor. In general, varistors having low C values have been correspondingly low $\alpha$ values.

Recently, U.S. Pat. No. 4,169,071, to Eda, et al, has described a varistor having the desired low varistor voltage characteristics, which includes in the body thereof, a zinc oxide component comprising 10 to 100 weight percent of zinc oxide grains having a grain size in the range from 100 to 500 microns and preferably from 100 to 300 microns. These relatively large zinc oxide grains are formed by providing, during manufacture of the zinc oxide varistor, 0.1 to 60 weight percent of zinc oxide seed grains having an initial size of 20–200 microns which grow during sintering to the aforementioned 100 to 500 micron size. The seed grains grow by absorbing neighboring zinc oxide particles which particles have a size usually in the range of 0.1 to 2 microns. The seed grains themselves may be formed of either single crystal or polycrystalline zinc oxide. Single crystal zinc oxide seed grains can be made by pulverizing zinc oxide single crystals having a very large crystal size. Alternatively, zinc oxide powder in combination with a soluble grain growth promoting agent is heated and fired for a time between about 0.5 and 50 hours. By crushing the thus fired mixture followed by soaking and leaching to remove the soluble grain growth promoting agents from the grain boundaries, large size single crystal grains are produced from which grains the desired size range may be obtained by classification through a sieve. In order for the large grains to be isolated by leaching of grain growth promoting agents, the presence of nonsoluble materials such as bismuth oxide which segregate to the grain boundaries, must be avoided.

In addition to the above described seed grains, Eda describes the use of an antimony zinc oxide spinel in the form: $Zn_{7/3}Sb_{2/3}O_4$ in polycrystalline form for reducing leakage current.

While the foregoing technique may well produce varistors having the desired low voltage characteristics, it is expensive and time consuming and greatly increases the cost of the varistor inasmuch as many additional steps are required in order to produce the zinc oxide seed grains as well as the antimony zinc oxide spinel. Large size single crystal zinc oxide material is both expensive to manufacture and not commonly available. The production of seed grains through the use of a water soluble grain growth promoting agent is undesirable inasmuch as many additional steps are required over standard varistor processing. In addition, the seed grain sizes as well as the amount of seed grain material produced by the method described in the foregoing patent have not been found to be particularly effective.

Accordingly, it is an object of this invention to provide a voltage dependent varistor having low varistor voltage, high alpha, low cost, low leakage and ease of manufacture.

It is another object of this invention to provide a new and improved method for manufacturing zinc oxide seed grains which may be utilized to produce a low varistor voltage metal oxide varistor having the foregoing characteristics without the need for a separate leakage reducing additive.

Briefly stated and in accordance with one aspect of this invention metal oxide varistors and preferably zinc oxide varistors having low varistor voltage, high alpha and low leakage current as well as other desirable electrical characteristics are manufactured by mixing zinc oxide as a major constituent with one or more additives which are preferably metal oxides as minor constituents and a relatively small amount of tetragonal-antimony-zinc-oxide (hereinafter TAZO). The mixture is pressed and sintered at an elevated temperature, electrodes and leads are attached and the device may then be utilized. While the percentage of TAZO which is added to the varistor mixture may vary over a wide range in accordance with this invention, it is preferred to employ a few percent by weight.

The preparation of TAZO proceeds by mixing zinc oxide and antimony oxide, pressing the mixture and sintering at an elevated temperature. The sintered body includes a white outer layer and a yellow-orange core which core contains the desired TAZO material. The white layer is removed, and the core is crushed and classified to produce the desired size TAZO particles. Preferably particles on the order of 20 microns or less are employed.

While the weight percent of TAZO particles required to achieve the desired reduction in varistor voltage is not critical once a minimum amount is passed, it is preferred to use a few percent by weight of TAZO particles formed as described above. The varistor mixture including the TAZO particles is pressed and sintered, for example, at 1300° C. for about one hour to form the varistor body.

The features of the invention which are believed to be novel are pointed out with particularity in the appended claims. The invention itself, however, both as to its organization and method of operation together with further objects and advantages thereof may best be understood by reference to the following description taken in connection with the accompanying drawings in which:

FIG. 1 is a cross sectional view of a voltage dependent resistor in accordance with this invention.

Before proceeding with a detailed description of the manufacturing process of the voltage dependent resistor contemplated by this invention, its construction will be described with reference to the single figure wherein Reference 10 designates, as a whole, a voltage dependent resistor comprising as its active element a sintered body having a pair of electrodes 12 and 13 in ohmic contact therewith applied to opposite surfaces thereof. The sintered body 16 is prepared in a matter hereinafter set forth and is in any form such as circular, square or rectangular plate form. Wire leads 18 and 20 are attached conductively to electrodes 12 and 14 respectively by connecting means 22 such as solder or the like.

It is known that a metal oxide varistor to the type shown exhibits low varistor voltage when the sintered body portion has a high percentage of relatively large grains of metal oxide and especially zinc oxide. For example, in a zinc oxide varistor, a grain size in the range of from 100 to 500 microns and preferably 100–200 microns is provided, uniformly dispersed in the sintered body. Normally, in the heretofore commonly employed methods for forming zinc oxide varistors, such large grain sizes are not produced. It has been reported by Eda, et al, that such large grain sizes are formed when seed grains of zinc oxide having a grain size between about 20 and 200 microns are included in the zinc oxide formulation prior to sintering. In addition to the large seed grains required by the process described by Eda, in order to achieve satisfactory leakage characteristics especially at high temperatures, Eda requires the addition of spinel type polycrystalline $Zn_{7/3}Sb_{2/3}O_4$ to the varistor mixture which is then mixed in a wet mill so as to produce homogeneous mixtures.

It has been discovered in accordance with this invention that the expensive single crystal zinc oxide seed grains heretofore produced either by crushing large zinc oxide single crystals or by dissolving the water soluble intergranular layers from sintered zinc oxide bodies especially formed using grain growth enhancing additives to produce large grains, are not required, and that substantially easier to manufacture nuclei may be employed to provide equally satisfactory and in many ways superior results. Further, the necessity for separately adding spinel type polycrystalline $Zn_{7/3}Sb_{2/3}O_4$ is eliminated by applicant's use of tetragonal-antimony-zinc-oxide (TAZO)nuclei.

In accordance with a presently preferred embodiment of this invention, a low voltage varistor is formed by combining zinc oxide powder as a major constituent with one or more additives which produce the desired nonlinear characteristics and between 0.1 and 20% by weight of TAZO nuclei for promoting the growth of large zinc oxide grains in the device and producing a low varistor voltage as well as low high temperature leakage current characteristics. Preferably the TAZO nuclei have a particle size several times that of the zinc oxide powder so, for example, nuclei of 1 micron size or greater are preferred.

The preparation of the TAZO nuclei relies upon the chemical reaction between antimony trioxide and zinc oxide according to the following chemical reaction:

$$Sb_2O_3+ZnO \rightarrow ZnSb_2O_4$$

the reaction product being in tetragonal form. The TAZO nuclei are prepared by combining particulate zinc oxide with particulate antimony oxide and thoroughly mixing to insure even distribution. The mixture is then pressed into large discs or other convenient forms in the same manner that metal oxide varistors are pressed prior to sintering. The discs are then sintered at a temperature between about 500° and 1300° C. and preferably between 900° and 1200° C. The sintered discs exhibit a yellow-orange core surrounded by a light-colored peripheral layer. The peripheral layer consists primarily of zinc oxide and is thought to result from the evaporation of antimony from the body during sintering. The peripheral layer is mechanically removed and the core material which is rich in TAZO is pulverized and classified to provide the desired range and distribution of particle sizes up to about 50 microns. Preferably classification through a 325 mesh sieve is performed to provide a nominal particle size of about 6 microns wherein greater than 90% of the particles are below 20 microns.

It has been determined that the form of antimony zinc oxide produced by reacting zinc oxide and antimony oxide depends upon the relative amount of each material available as well as the amount of oxygen present. Where an excess of zinc oxide and oxygen is present as is the case when the powders are combined and sintered in oxygen or in air, the reaction proceeds as described the the following equation:

$$Sb_2O_3+7ZnO+O_2 \rightarrow Zn_7Sb_2O_{12}$$

which reaction product is often written in equivalent form as $Zn_{7/3}Sb_{2/3}O_4$ and is in the spinel form.

By pressing the zinc oxide-antimony oxide mixture prior to sintering, the effect of oxygen on the reaction and the evaporation of antimony oxide are reduced. The tetragonal form of antimony zinc oxide is primarily produced. The pressing of the zinc oxide and antimony oxide powders may be conveniently performed in the same manner as the varistor discs themselves are pressed prior to sintering. Preferably the mixture of powders is pressed to a density of at least 3 grams/cc.

In accordance with an exemplary embodiment of this first aspect of the present invention, a relatively low voltage varistor formulation was pressed into discs and sintered at about 1300° C. for 1 hour. The varistor formulation includes zinc oxide as a major constituent as well as bismuth oxide, cobalt oxide, manganese oxide, titanium oxide, chromium oxide, boron oxide and TAZO. The following characteristics were measured.

TABLE I

| $I_L$ ($\mu$A) | $\alpha$ | $V_1$ | V/mm |
|---|---|---|---|
| 0.6 | 21 | 23 | 18 |

Wherein $I_L$ is the leakage current of the varistor, $\alpha$ is the alpha as hereinabove described, $V_1$ is the varistor voltage at 1 milliampere and V/mm is the volts per millimeter of thickness of the device.

In order to appreciate the significance of the results illustrated at Table I, a varistor was prepared identically with that hereinabove described except that the TAZO nuclei were deleted and a like amount of zinc oxide seed grains as described by Eda et al, were substituted therefore with the results presented in Table II.

TABLE II

| $I_L$ (μA) | α | $V_1$ | V/mm |
|---|---|---|---|
| 1.2 | 17 | 20 | 14 |

It will be seen that the α, $V_1$ and volts per millimeter characteristics of the device including the TAZO nuclei and the device including the zinc oxide seed grains are similar but that the leakage current of the varistor formed in accordance with the teachings of this invention is substantially lower than the leakage current of the varistor formed without benefit of this invention. It will be recognized, that the varistor whose characteristics are presented in Table II did not include the spinel type polycrystalline antimony zinc oxide in the form $Zn_{7/3}Sb_{2/3}O_4$. Eda, et al claims that the addition of the spinel would have a positive effect on leakage current. The advantage of this invention resides in the elimination of the necessity for preparing and adding the spinel to the varistor mixture in addition to the seed grains thus providing great economy of fabrication.

The amount of TAZO nuclei added to the varistor formulation may vary over a wide range without departing from the true spirit and scope of this invention. It has been determined, however, that beyond about 10% by weight of TAZO, the effect on varistor voltage is reduced substantially. Preferably less than about 5% by weight of TAZO nuclei are utilized with substantial decrease in varistor voltage and the desirable reduction in leakage and varistor voltage may be obtained utilizing substantially less than 1% by weight of TAZO provided uniform distribution on the varistor mixture is achieved.

While this invention has been described in connection with certain presently preferred embodiments thereof, those skilled in the art will recognize that many modifications and changes may be made therein without departing from the true spirit and scope of the invention which accordingly is intended to be defined solely by the appended claims.

What is claimed is:

1. An additive for reducing the varistor voltage and the leakage current of zinc oxide varistors consisting of particulate tetragonal-antimony-zinc-oxide of the form $ZnSb_2O_4$.

2. The additive of claim 1 wherein said particulate antimony zinc oxide has a particle size less than about 50 microns.

3. The additive of claim 1 wherein said particulate antimony zinc oxide has a particle size between about 5 and about 20 microns.

4. A method for making a metal oxide varistor having low voltage and low leakage comprising combining zinc oxide as a major constituent, bismuth oxide and one or more other metal oxides as minor constituents, and a varistor voltage-reducing additive of less than 10 weight percent of particulate tetragonal $ZnSb_2O_4$ having a particle size of less than about 50 microns; pressing said combination to form a body; and sintering said body at a temperature of about 1300° C.

5. A metal oxide varistor having low varistor voltage and low leakage comprising zinc oxide as a major constituent, bismuth oxide and at least one other metal oxide as minor constituents, and a varistor voltage-reducing additive of from 0.1 to 10% by weight of particulate tetragonal $ZnSb_2O_4$.

* * * * *